United States Patent [19]

Griffis

[11] 3,990,170

[45] Nov. 9, 1976

[54] CARTRIDGE RESERVOIR

[76] Inventor: William T. Griffis, 201 Cypress Drive, Apt. 2, Laguna Beach, Calif. 92651

[22] Filed: June 30, 1975

[21] Appl. No.: 591,611

[52] U.S. Cl. ..... 42/89; 206/3; 224/20

[51] Int. Cl.[2] ..... F41C 27/00; F42B 39/04

[58] Field of Search ..... 42/87–89; 206/3; 224/13, 15, 17, 20, 21

[56] References Cited

UNITED STATES PATENTS

| | | | |
|---|---|---|---|
| 2,399,904 | 5/1946 | Baucum | 42/89 |
| 2,795,323 | 6/1957 | Amundsen | 206/3 |
| 2,920,893 | 1/1960 | Walker | 42/87 |
| 3,593,873 | 7/1971 | Vonk | 206/3 |
| 3,769,733 | 11/1973 | Nelson | 42/89 |

*Primary Examiner*—Charles T. Jordan
*Attorney, Agent, or Firm*—William C. Babcock

[57] ABSTRACT

A portable cartridge reservoir that includes first and second rectangular cups having handles projecting from first ends thereof, with the cups being pivotally connected on their second ends, and when in a first position, the cups having the free rectangular edges thereof in abutting contact. A tray is provided that is removably supported in the first cup. The tray supports a number of cartridges in spaced groups, with the spacing of the cartridges in each group being such that they may be slidably inserted in a revolver reloading device when the body of the latter is moved inwardly towards the tray when the cups are in a second position.

When in the first position the cups preferably define a first compartment therein in which a loaded revolver reloader is disposed for instant use. Also, when the cups are in a first position the reservoir may be carried or supported in a depending position from the handles thereof.

7 Claims, 5 Drawing Figures

FIG. 1
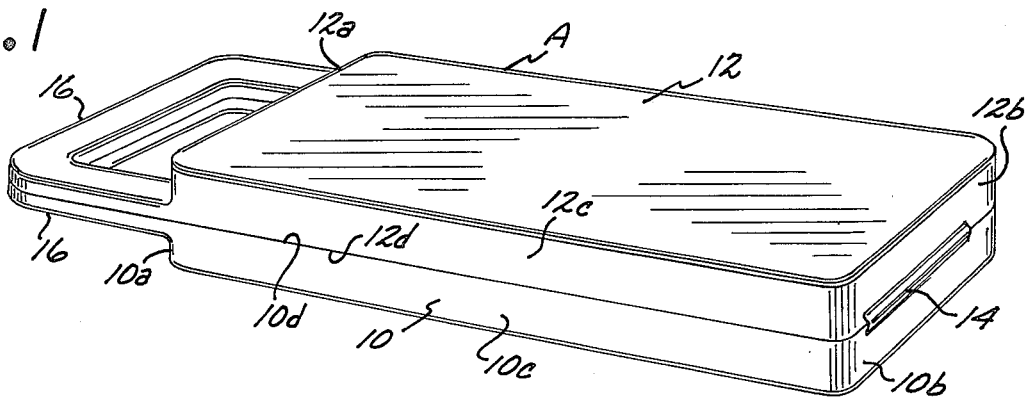
FIG. 4
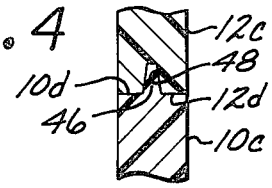
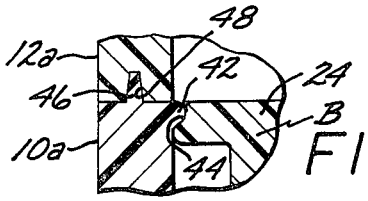
FIG. 5
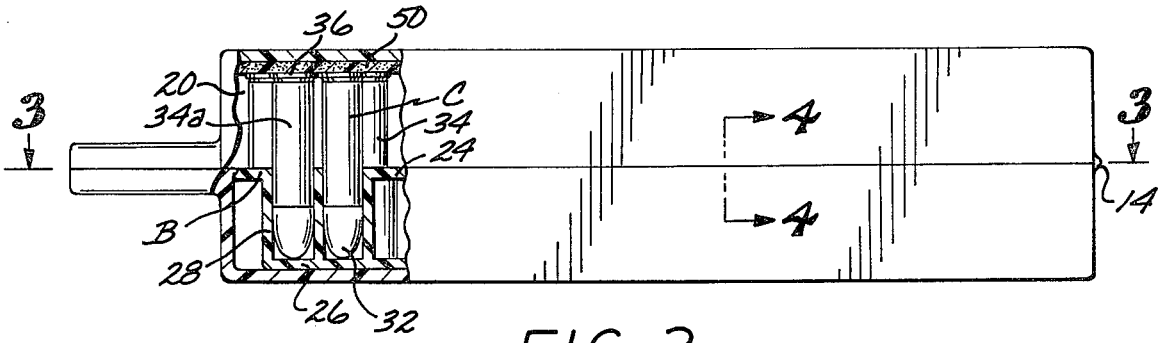
FIG. 2
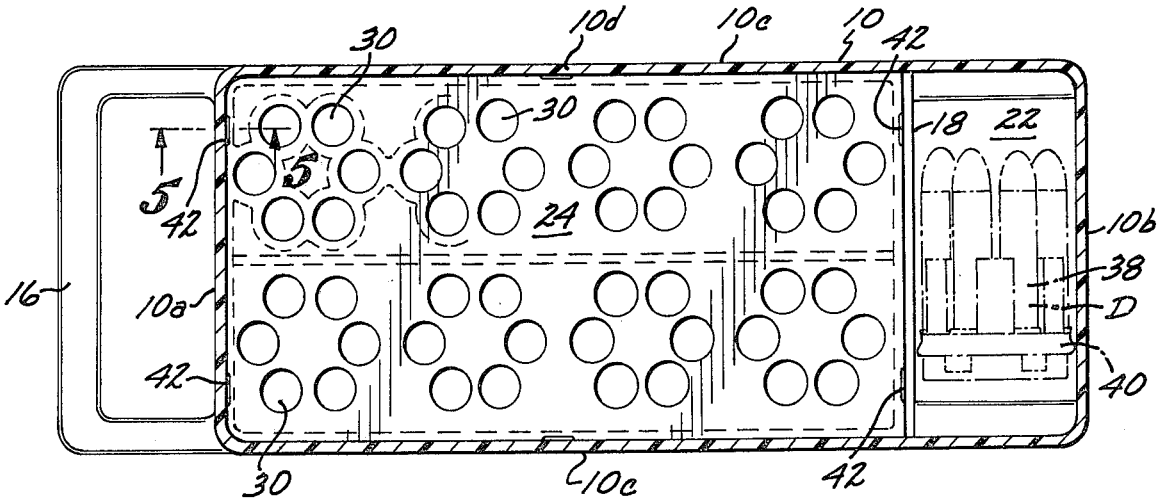
FIG. 3

CARTRIDGE RESERVOIR

BACKGROUND OF THE INVENTION

1. Field of the Invention

A cartridge reservoir.

2. Description of the Prior Art

In my U.S. Pat. No. 3,769,732, entitled "Revolver Reloading Device" which issued on Nov. 6, 1973, a device is disclosed and claimed that permits the cylinder of a revolver to be reloaded with cartridges in a minimum of time. My reloader, identified above, includes a body in which the cartridges are removably supported in recesses therein, and with the cartridges being ejected from the body into a cylinder of a revolver when a ring on the body of the reloader is slid longitudinally and forwardly relative thereto.

The primary purpose in devising the present invention is to provide a portable reservoir in which a number of cartridges are removably supported in groups, with the spacing of the cartridges in each group being such that the group of cartridges may be slidably inserted into my reloader when the body of the latter is moved inwardly towards the reservoir.

The primary object of the present invention is to supply a portable cartridge reservoir for police officers, guards, and members of the armed services that permits the easy transportation of a large number of cartridges, with the cartridges being so held in the invention that they may be inserted in groups into revolver-reloading devices, when the reloading devices are moved inwardly towards that portion of the invention supporting the cartridges.

SUMMARY OF THE INVENTION

The cartridge reservoir is preferably used in combination with a revolver-reloading device of the type that includes a cylindrical body having a number of circumferentially spaced, parallel, bores and slots defined therein, with the bores being capable of removably supporting a number of cartridges in projecting positions. The cartridge reservoir carries a large number of cartridges arranged in groups, with the cartridges in each group being so spaced that they may be slid into the confines of one of the revolver-reloading devices when the reloading device is moved inwardly towards that portion of the reservoir supporting the cartridges.

In detail, the cartridge reservoir includes first and second rectangular cups having first and second ends, with the cups adjacent the second ends having interior transverse partitions that subdivide the interior of the cups into first and second compartments when the cups are in a first position in which the marginal edges of the cups are in abutting contact. The cups are pivotally connected to one another by hinge beams secured to or formed as part of the ends of the cups.

A rectangular tray of substantially the same depth as the interior of the first cup is removably disposed therein, with the tray having a number of groups of recesses formed therein. The recesses in each of the groups are spaced and capable of being so removably supporting a number of cartridges in upwardly extending positions, when the body of a reloading device is slid downwardly over a group of the upwardly extending cartridges. The cartridges are inserted into the body as a group to be held therein, are ejected from the body into the cylinder of a revolver when a ring that is slidably mounted on the body is moved longitudinally and and forwardly relative thereto.

The reservoir includes means for removably holding the tray in a fixed position within the confines of that portion of the first cup which partially defines the first compartment. First and second handles project from the first ends of the first and second cups, and when the handles are adjacently disposed, they may be concurrently grasped by the hand of a user to permit the cartridge reservoir to be carried in a depending position, or supported in a depending position from a bracket or a hook.

BRIEF DESCRIPTION OF THE DRAWINGS

FIG. 1 is a perspective view of the cartridge reservoir in a closed position;

FIG. 2 is a combined side-elevational and longitudinal cross-sectional view of the device shown in FIG. 1;

FIG. 3 is a longitudinal cross-sectional view of the device taken on the line 3—3 of FIG. 2;

FIG. 4 is an enlarged fragmentary transverse cross-sectional view of the device shown in FIG. 2, taken on the line 4—4 thereof; and FIG. 5 is an enlarged fragmentary transverse cross-sectional view of the device shown in FIG. 3, taken on the line 5—5 thereof.

DESCRIPTION OF THE PREFERRED EMBODIMENTS

The portable cartridge reservoir A, as may best be seen in FIGS. 1, 2 and 3, includes a first rectangular cup 10 and second rectangular cup 12 that are of the same transverse cross section. The cups 10 and 12 are conveniently formed by injection molding from a suitable commercially available polymerized resin.

The first rectangular cup 10 includes a first end wall 10*a*, second end wall 10*b*, and a pair of side walls 10*c* which extend between the first and second end walls. The second rectangular cup 12 includes a first end wall 12*a*, second end wall 12*b*, and a pair of connecting side walls 12*c*. The first and second rectangular cups 10 and 12 respectively include free marginal end portions 10*d* and 12*d*, respectively, that are in abutting contact when the cups are in the first position shown in FIG. 1.

The first and second rectangular cups 10 and 12 include hinge means 14 on the second end walls 10*b* and 12*b* thereof, which pivotally connect the rectangular cups 10 and 12 to permit them to be disposed either in a first position as shown in FIG. 1 or in a second position (not shown) where they are in substantially longitudinal alignment in a common plane.

The first and second rectangular cups 10 and 12 adjacent the second end walls 10*b* and 12*b* thereof have transverse partitions 18 formed in the interior thereof, with these partitions when the cups are disposed in the first position shown in FIG. 1 serving to subdivide the interior of the cup into the first and second compartments 20 and 22, respectively, as may be seen in FIG. 3.

A tray B is provided that is best seen in FIGS. 2 and 3, which tray includes a flat top 24, bottom 26, and a number of tubular members 28 which extend therebetween, and cooperate with the top and bottom to define a number of spaced elongate recesses 30 that are arranged in groups.

The recesses 30, as shown in FIG. 2, removably support a number of cartridges C which have the bullets 32 thereof downwardly disposed, with the shells 34 of the cartridges having portions 34*a* thereof extending above the top 24. The detonator ends 36 of the cartridges C are adjacently disposed to the interior surface of the second rectangular cup 12. When the first and second rectangular cups 10 and 12 are in the first position to define the second compartment 22, the second compartment may be used to removably support a revolver-reloading device D of the type described and claimed in detail in my U.S. Pat. No. 3,769,732 that issued on Nov. 6, 1973.

The revolver reloader D includes a cylindrical body 38 that has a ring 40 slidably mounted thereon, with the body having bores formed therein in which the cartridges C may be slidably inserted as a group when the body 38 is moved downwardly relative to the top 24 of tray B. Such downward movement of body 38 can take place only when the first and second rectangular cups are in a second position where they are in substantially longitudinal alignment. When the reloader D is disposed in the second compartment 22, it is preferably in a loaded condition to permit the rapid use thereof in reloading a revolver.

The first rectangular cup 10 has at least one resilient rib 42 projecting inwardly from the first end wall 10*a* thereof into the first compartment 20, as shown in FIG. 3, and the partition 18 likewise has at least one resilient rib 42 projecting into the first compartment. The ribs 42 above identified, serve to removably engage recesses 44 formed in the end portion of the top 24 of tray B, as may best be seen in FIG. 5, to removably support the tray within the confines of the first cup 10, as shown in FIG. 2.

The shell portions 34*a* of the cartridges C project upwardly above the top 24 of tray B a sufficient distance that the cartridges are removably locked into one of the reloaders D when the latter is moved towards the top 24 to slidably engage the cartridges in one of the groups of the recesses 30.

From the free marginal edges 10*d* of the first rectangular cup 10 a tongue 46 extends upwardly that is snugly but removably disposed in a groove 48 which extends inwardly from the free marginal edge 12*d* of the second rectangular cup 12. The tongue 46 and groove 48 preferably extend longitudinally along the side of the first and second cups 10 and 12, as well as transversely across the first end walls 10*a* and 12*a* thereof, and by so doing, minimize the entry of foreign material into the confines of the first and second rectangular cups 10 and 12 when they are in the first positions shown in FIG. 1.

When the first and second cups 10 and 12 are in the first position the handles 16 are in abutting contact, and the handles are capable of being concurrently grasped by the hand (not shown) of a user to permit the cartridge reservoir A to be carried in a depending position, or supported in a depending position from a hook or bracket (not shown). Those portions of the second rectangular cup 12 most adjacent to the detonator end 36 of the cartridges C, as shown in FIG. 2, has a resilient pad 50 secured thereto, which pad, together with the bottom 26 of tray B cooperatively prevent any substantial lateral movement of the cartridges C when the reservoir A is being transported from place to place.

The use and operation of the invention has been explained previously in detail and need not be repeated.

I claim:

1. In combination with a revolver-reloading device of the type that includes a cylindrical body having a plurality of circumferentially spaced parallel bores and slots defined therein, said bores being capable of removably supporting a plurality of cartridges in projecting positions and so aligned as to be ejectable into a cylinder of a revolver when a ring which supports a plurality of fingers that extend into said bores through said slots is slid longitudinally on said body from a first to a second position, a portable cartridge reservoir for refilling said revolver-reloading device, which cartridge reservoir comprises:

a. first and second rectangular cups having first and second ends, which first and second cups adjacent said second ends have transverse partitions formed therein, and said first and second cups include free marginal edge portions that may be disposed in abutting contact;

b. hinge means connected to said second ends of said first and second cups to permit said cups to be pivoted to first positions where said marginal edge portions are in abutting contact and said transverse partitions are aligned and cooperate with said first and second cups to define first and second confined spaces within the interior thereof, with said second confined space being of sufficient size as to permit one of said reloading devices filled with cartridges to be disposed therein, and with said hinge means permitting said cups to be pivoted to second positions where access may be had to the interior thereof;

c. a rectangular tray of substantially the same depth as the interior of said first cup that is removably disposed therein between said first end of said first cup and said partition therein, with said tray having a plurality of groups of recesses therein, and with the recesses in each of said groups being spaced and capable of so removably supporting a plurality of cartridges in upwardly extending positions that said body of said reloading device may be slid downwardly thereover when said ring is in said first position to permit said cartridges in one of said groups to be disposed in said bores for subsequent transfer to said cylinder of said revolver;

d. first means for removably locking said tray in said first cup; and e. first and second U-shaped handles that project from said first ends of said first and second cups and may be concurrently grasped by the hand of a user to carry said cartridge reservoir in a depending position therefrom.

2. A cartridge reservoir as defined in claim 1 wherein the depth of said first confined space when said cups are in said first position is such that the firing ends of said cartridges are disposed adjacent to the interior surface of said second cup when the bullet ends of said cartridges are disposed in said recesses.

3. A cartridge reservoir as defined in claim 2 which further includes:

f. a resilient pad secured to the interior of said second cup and so disposed as to be in pressure contact with cartridges in said recesses when said first and second cups are in said first position to prevent movement of said cartridges relative to said first and second cups when the latter are in said first position and with said cartridge reservoir being carried in a depending position by said handles.

4. A cartridge reservoir as defined in claim 1 wherein said first and second cups are formed from a resilient polymerized resin.

5. A cartridge reservoir as defined in claim 4 which further includes:

f. engaging and engageable means defined on the free marginal edge portions of said first and second cups that are in engagement when said first and second cups are in said first position and tend to so maintain said first and second cups until transversely directed forces are exerted on said first and second handles.

6. A cartridge reservoir as defined in claim 5 wherein said engaging and engageable means are tongue and grooves defined on said free marginal edge portions of said first and second cups.

7. A cartridge reservoir as defined in claim 1 wherein said first means are a plurality of spaced resilient lips that extend inwardly from said free marginal edge portion of said first cup and removably engage recesses defined in said tray.

* * * * *